US012366141B2

(12) United States Patent
MacGillivray et al.

(10) Patent No.: US 12,366,141 B2
(45) Date of Patent: Jul. 22, 2025

(54) SEGMENTED GUN COMPONENTS WITH INTEGRATED CONTACTS

(71) Applicant: Halliburton Energy Services, Inc., Houston, TX (US)

(72) Inventors: Joseph Todd MacGillivray, Alvarado, TX (US); Matthew Craig Mlcak, Alvarado, TX (US); Kevin Cook, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/363,475

(22) Filed: Aug. 1, 2023

(65) Prior Publication Data

US 2025/0043664 A1 Feb. 6, 2025

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC ..... E21B 43/117; E21B 43/1185
See application file for complete search history.

(56) References Cited

U.S. PATENT DOCUMENTS 9,194,219 B1 * 11/2015 Hardesty ..... F42D 1/06
11,480,038 B2 * 10/2022 Eitschberger ..... E21B 43/1185
2016/0061572 A1 3/2016 Eitschberger et al.
2016/0168961 A1 6/2016 Parks et al.
2017/0052011 A1 2/2017 Parks et al.
2017/0276465 A1 9/2017 Parks et al.
2018/0202789 A1 7/2018 Parks et al.
2018/0202790 A1 7/2018 Parks et al.
2018/0299239 A1 * 10/2018 Eitschberger ..... H05K 5/069
2019/0212118 A1 * 7/2019 Saltarelli ..... E21B 43/1185
2020/0072029 A1 * 3/2020 Anthony ..... E21B 43/117
2020/0199983 A1 6/2020 Preiss et al.
2020/0256168 A1 * 8/2020 Knight ..... E21B 43/119
2021/0277752 A1 9/2021 Eitschberger
2021/0396103 A1 * 12/2021 MacGillivray ... E21B 43/11855
2022/0120165 A1 4/2022 Shelton
2022/0186588 A1 6/2022 Shelton et al.
2022/0213767 A1 7/2022 Prisbell et al.
2023/0008361 A1 1/2023 Lowe et al.
2023/0106595 A1 * 4/2023 Eitschberger ..... E21B 43/1185 166/297
2023/0203923 A1 6/2023 Eitschberger
2024/0003229 A1 * 1/2024 Prisbell ..... E21B 43/119
2024/0210151 A1 * 6/2024 Roberts ..... E21B 17/028

OTHER PUBLICATIONS

"PCT Application No. PCT/US2023/071553, International Search Report and Written Opinion", May 1, 2024, 11 pages.

* cited by examiner

*Primary Examiner* — Shane Bomar
(74) *Attorney, Agent, or Firm* — DeLizio, Peacock, Lewin & Guerra LLP

(57) ABSTRACT

Some implementations include a modular gun system for use in a wellbore comprising one or more charge segments each including a first electrical conductor having a first set of integrated electrical contacts.

20 Claims, 3 Drawing Sheets

SEGMENTED GUN COMPONENTS WITH INTEGRATED CONTACTS

BACKGROUND

Perforating guns may be utilized in oil & gas completions operations to propel projectiles into one or more subsurface formations, thus creating initial fractures which may be propagated during hydraulic fracturing. Current select-fire gun systems utilize a wire run throughout the perforating gun to provide power to a detonator. Since each perforating gun in a gun string comprises its own detonator, multiple wires may be used. These wires may be prone to damage during assembly, handling, conveyance into the wellbore, during firing, etc. Damage to the wires may cause an open connection/circuit to occur, and some of the charges within the gun may fail to fire.

BRIEF DESCRIPTION OF THE DRAWINGS

Implementations of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. In other instances, well-known instruction instances, protocols, structures, and techniques have not been shown in detail in order not to obfuscate the description.

To minimize electrical failures in the perforating gun system, a modular gun system configuration without a wire may be used. The electrical connection to the detonator may instead be maintained by utilizing segmented charge holder segments that have electrical contacts integrated or otherwise molded within. The modularity of the charge segments may simplify the assembly process and allow for automation of the process, thus reducing labor and other associated costs. The elimination of the wire within the gun system may mitigate potential quality assurance (QA) issues and increase its reliability and service quality.

Example Modular Charge Segment

Figure 1:
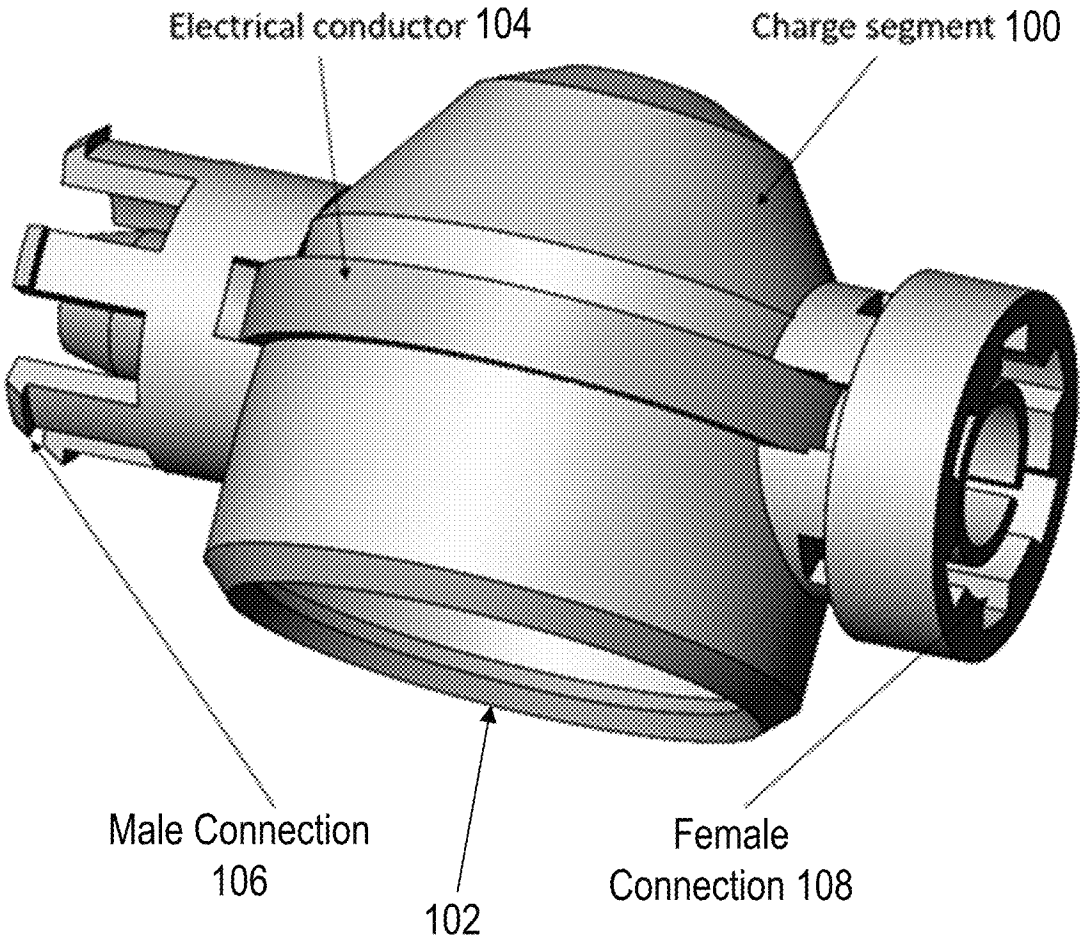
FIG. 1 is an illustration depicting an example charge segment for use in a perforating gun, according to some implementations.

An example modular charge segment with an electrical conductor to be used in a downhole perforating gun system is now described. FIG. 1 is an illustration depicting an example charge segment 100 for use in a perforating gun, according to some implementations. The charge segment 100 may be a molded plastic housing comprised of an electrically-insulated molded plastic. For example, the charge segment 100 may be comprised of materials including, but not limited to polyetheretherketone (PEEK), Nylon, polylactic acid (PLA), polycarbonate (PC), polyamide (PA), and other electrically-insulated plastics. In some implementations, the charge segment 100 may be comprised of steel. Other implementations may utilize the above electrically-insulated materials. In some implementations, the charge segment 100 may be formed by injection molding. In other implementations, the charge segment 100 may be 3D printed. The charge segment 100 may also be machined, however, some implementations may utilize injection molding or 3D printing to create the charge segment 100. Creating the charge segment 100 from plastic may enable the use of the electrical conductor 104 to carry power through the gun system instead of one or more wires, and the charge segment 100 may also be cheaper to manufacture than a similar charge segment comprised of steel.

The charge segment 100 may be configured to carry a shaped charge. For example, the shaped charge may be loaded either by on-site personnel or an automated device into a charge space 102. A perforating gun may comprise multiple charge segments (similar to the charge segment 100) loaded into a gun carrier, and the perforating gun may be conveyed into a wellbore to perforate one or more subsurface formations. The charge segment 100 may comprise an internal conical liner as part of the shaped charge. The liner may be in contact with one or more explosive powders (primer, a secondary explosive, etc.), and a casing to house the explosive components. The casing may be an exterior of the charge segment 100 (i.e., the portion visible in FIG. 1). In some implementations, a detonating cord may extend from a back end of the charge segment 100, opposite of the charge space 102.

An electrical conductor 104 may be coupled to the charge segment 100. The electrical conductor 104 may be comprised of materials including, but not limited to copper, brass, and steel. In some implementations, the electrical conductor 104 may be comprised a non-metal or non-conductive material that has been plated with a conductive material. In some implementations, the electrical conductor 104 may be configured to wrap around an exterior of the charge segment 100. In other implementations, the electrical conductor 104 may be positioned internally within the charge segment 100 but outside ballistic/explosive components in the interior of the charge segment 100. For example, the charge segment 100 may be overmolded over the electrical conductor 104. Overmolding may refer to a process of injection molding where an outer mold is formed over an inner mold or object. Overmolding may achieve positions and configurations with varying components that may be difficult to achieve with manual assembly. In some implementations, overmolding may be utilized to embed the electrical conductor 104 within the walls of the charge segment 100.

Figure 2:
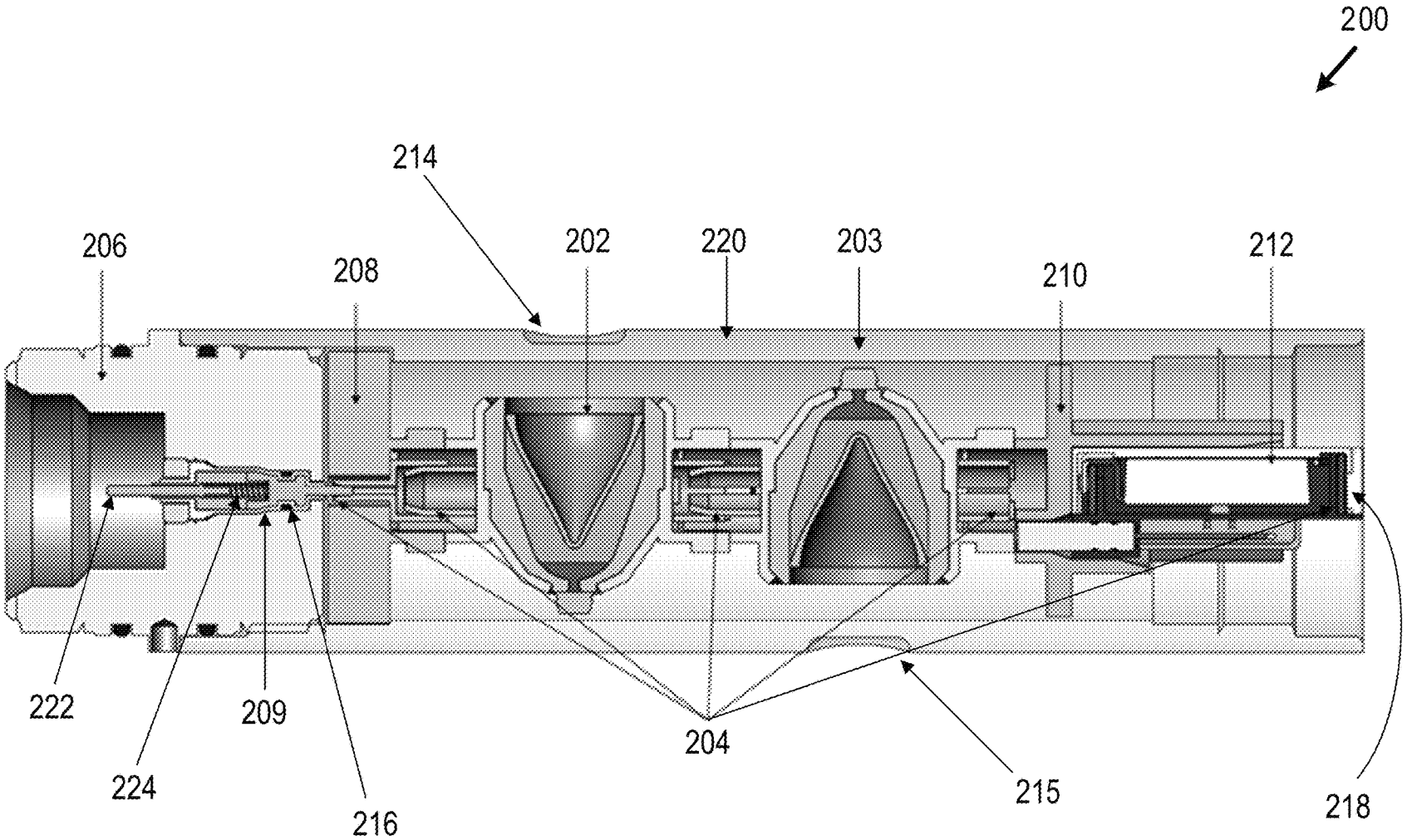
FIG. 2 is an illustration depicting an example modular perforating gun system, according to some implementations.

Rather than using a wire dispersed around the charge segment 100, the electrical conductor 104 is instead used to carry power to a detonator within the broader perforating gun system (discussed in FIG. 2). The charge segment 100 may comprise features to lock adjacent charge segments together and to maintain the electrical connection across various components. For example, the charge segment 100 may comprise integrated contacts at the ends of the electrical conductor 104 including a male connection 106 and a female connection 108. The male connection 106 may connect into the female connection 108 of a separate charge segment, and the female connection 108 may be configured to receive a male connection from a separate charge segment. The electrical conductor 104 may also comprise corresponding male and female connections to connect into and provide power to other charge segments. For example, in some implementations, the electrical conductor 104 may comprise a pin and socket style of electrical connection (as shown). In other implementations, other connection types may be possible. For example, a locking collet may couple with an extruded tab to mechanically lock into place. Crimp connections may also be used where a piece (formed from a ductile conductive material) of the electrical conductor 104 slides together with a similar component on a second conductor. The pieces may then be crimped mechanically and coupled. Other connections may utilize a standard collet and tab cutout connection, movable bent tabs that are configured to lock into place with one another, etc. Some implementations may also use spring elements as part of a spring and plate connection to form electrical connections across one or more charge segments 100. For example, a spring may be included proximate to either the male connection 106 or the female connection 108. The spring may extend from an annular space around the integrated contacts and maintain proper spacing with the neighboring charge segment (or other component) to retain the electrical connection during motion. In some implementations, the spring may be positioned on the charge segment 100 along an axis of the larger gun system. In other implementations, a spring may be positioned on one charge segment 100, and the spring may be configured to contact a flat pad on a neighboring charge segment when forming a connection between the two charge segments.

While a single electrical conductor 104 is depicted in FIG. 1, a second electrical conductor may be utilized for each charge segment 100. The secondary electrical conductor may be positioned parallel to the (primary) electrical conductor 104. The electrical conductor 104 may transfer power to and between various gun components, and the secondary electrical conductor may be included to carry the ground path electrical power. In some implementations, the electrical conductor 104 may be designed as a coaxial connection allowing for both power and ground paths.

Example Modular Gun System

FIG. 2 is an illustration depicting an example modular perforating gun system 200 (hereafter referred to as the gun system 200), according to some implementations. A charge segment 202, which may be similar to the charge segment 100 of FIG. 1, may comprise a shaped charge and corresponding ballistic components. Multiple charge segments may be coupled together (as shown) via the electrical conductors and integrated contacts rather than wires. For example, the charge segment 202 may be coupled to a charge segment 203 via their integrated contacts, similar to the male and female connections 106, 108 of FIG. 1, respectively. In some implementations, the integrated contacts may form a pin and socket connection between two electrical conductors. While FIG. 2 depicts only the charge segments 202 and 203, various numbers of charge segments may be utilized within the gun system 200.

A connection between electrical conductors may be formed between an integrated contact of the charge segment 202 and an integrated contact built into an end alignment portion 208. While traditional gun systems may use an end alignment comprising a wired connection, the end alignment portion 208 may utilize the integrated contact to maintain an electrical connection with the charge segment 202. In some implementations, the integrated contact within the end alignment portion 208 may be a metal or metal alloy similar to those used for the electrical conductor 104, such as brass, copper, and steel, although other materials may be used. The end alignment portion 208 may be configured to maintain an alignment of the charge segments 202, 203 with one or more sacrificial regions 214-215. The end alignment portion 208 may comprise a larger outer diameter (OD) than an inner diameter (ID) of the gun body 220, and this larger OD enables the charge segments 202-203 to be aligned with an axis of a gun body 220 during assembly. The sacrificial regions 214-215 may comprise recessed areas in the gun body 220 where shaped charges of the charge segments 202-203 may be discharged from. The sacrificial regions 214-215 are intended to be consumed when firing charges from the charge segments 202-203, thus reducing damage to the gun body 220. In some implementations, the sacrificial regions 214-215 may be scallops, bands disposed circumferentially around the gun body 220 (i.e., part of a banded gun body), grooves (as part of a grooved gun body), sacrificial regions as part of a Slickwall gun body, etc.

At the other end of the gun system 200, a wireless electrical connection may be maintained between the charge segment 203 and a detonator sleeve 210 via integrated contacts. The detonator sleeve 210 may comprise a similar integrated contact to the end alignment portion 208. The detonator sleeve 210 may include a molded plastic housing that houses a detonator assembly 212. The detonator assembly 212 houses the detonator. The detonator assembly 212 may be selectively fire-able, and each gun system 200 may comprise its own detonator. As mentioned prior, a detonation cord may extend through a back portion of the charge segments 202-203 at an opposite end of the scallops 214-215, respectively. The detonation cord terminates into the detonator sleeve 210.

Shaped charges may be snapped into each of the charge segments 202, 203, and the charge segments 202, 203 may be coupled together via their integrated contacts. In some implementations, the charge segments 202, 203 may hold a single shaped charge. In other implementations, each of the charge segments 202, 203 may be designed to carry multiple charges. The multiple charges may be oriented in a single plane (i.e., at 0° phasing) although other configurations may be possible. In other implementations, one or more charges may each be oriented at a different angle, and each charge segment may include charges having a phasing greater than 0°. For example, a charge segment may comprise a phasing of 180° where one or more charges may be oriented in a first direction (parallel with 0° phasing) while one or more charges within the same charge segment may be oriented towards the opposite direction. Phasing may refer to the angular difference between successive charges or charge segments, depending on context. In a gun system comprising a 60° phasing, this would imply that six charge segments are oriented to face 60° apart from neighboring charge segments.

With regard to phasing, the charge segments 202, 203 may be oriented in various phasings. The design of the charge segments 202, 203 may present advantages over traditional charge segments to achieve desired phasings. For example, traditional perforating guns may use a different type of charge segment for different types of phasing configurations. A traditional gun system with 60° phasing may use charge segments of different types and lengths than a traditional gun system with, for example, a 90° phasing. This traditional gun system may also use steel charge tubes comprising traditional wired charge segments. Traditional steel charge tubes may require a larger on-site inventory because of the heterogenous components (i.e., the various charge tube types and lengths) necessary to achieve the desired phasings in a perforating operation. Thus, these traditional charge segments may contribute to an accumulation of inventory at the well site.

In contrast, the charge segments 202-203 may be configured such that they may be assembled in a variety of phasings (0, 60, 90, 180, etc.) using a single component type. For example, the charge segments 202-203 may comprise integrated contacts similar to the male connection 106 and female connection 108 of FIG. 1. In each of the connections 106, 108, the pin and socket components may be configured to achieve various phasings simply by altering the radial angle at which the charge segments 202-203 are connected. In addition, the electrical conductor 104 may comprise collet-like features at the female connection 108 to accommodate a variety of connections for desired phasings. Thus, a single component may be used for all charge segments in the gun system 200, and a desired phasing may be achieved based on how the charge segments 202-203 are connected. This may lead to inventory reductions when compared to traditional charge tubes.

The modularity of the charge segments 202, 203 may simplify the assembly process over traditional wired charge segments used in traditional steel charge tubes. The assembly of a traditional gun system may include assembling charge tubes and wiring them by hand to other components. The wire may be threaded through the end alignment portion, through power receptacles on the charge segments, and eventually terminating in a detonator sleeve. Due to the potential use of heterogenous components with traditional charge tubes, charges may be loaded into charge tubes by hand. Thus, a simpler method of assembly may be more feasible to automate.

In contrast to traditional gun systems, the gun system 200 may be assembled via an automated process. Charges may be loaded into the charge segments 202-203 by an automated apparatus. The automated apparatus may comprise devices such as robotic arms or a plurality of individual machines operating with program code comprising commands to perform the assembly functions described herein. The charge segments 202-203 may be connected together by the automated apparatus to form a desired shot phasing for the gun system 200. In some implementations, one or more datum features such as datum axes, datum planes, datum points, etc. may be defined on the charge segments 202-203. The automated apparatus comprise program code configured to align two charge segments based on their datum features and a desired phasing. The automated apparatus may be configured to connect the end alignment portion 208 to the charge segment 202, the detonator sleeve 210 to the charge segment 203, and to connect a bulkhead assembly 206 (including a feedthrough 209) to the end alignment portion 208. In some implementations, the automated apparatus may be configured to position the connected gun components including the charge segments 202-203, the end alignment portion 208, the detonator sleeve 210, the feedthrough 209, and the bulkhead assembly 206 into the gun body 220. The final, assembled gun system 200 may then be deployed to a well site. In other implementations, these components may be assembled together by an automated apparatus, shipped to a well site, and the components may be placed into the gun body 220 during final assembly by personnel. The modular design of the charge segments 202-203 and simplified assembly process may reduce potential labor costs and minimize the assembly time of the gun system 200.

As briefly described above, the gun system 200 may further include the bulkhead assembly 206 and the feedthrough 209. The bulkhead assembly 206 may be positioned proximate to the end alignment portion 208 and may be configured to create a pressure barrier between gun systems. For example, the gun system 200 may form a threaded connection with a second gun system as part of a perforating string. When one gun system fires within the borehole, fluids do not seep into the fired gun and propagate throughout other unfired gun systems.

The feedthrough 209 may partially extend into an open space of the bulkhead assembly 206. Similar to the bulkhead assembly 206, the feedthrough 209 may also be configured to maintain a pressure seal with respect to neighboring guns in a gun string. The feedthrough 209 may also be configured to allow the transfer of power to a second gun. For example, threads disposed on the bulkhead assembly 206 may be configured to form a threaded connection with a second gun system, the threaded connection formed proximate to the detonator assembly of the second gun system. The feedthrough 209 may be configured to electrically couple to the detonator assembly of the second gun system, and the feedthrough 209 is electrically coupled with an integrated contact of the end alignment portion 208. Alternatively, a feedthrough from a second gun system may also be configured to electrically couple to the detonator assembly 212 when a threaded connection is formed at that side of the gun system 200.

A pin 222, as part of the feedthrough 209, may be configured to contact an electrical contact within the detonator assembly of a second gun system. As shown with reference to the gun system 200, a pin may be configured to contact an electrical contact 218 within the detonator assembly 212. In some implementations, the electrical contact 218 may be comprised of polycrystalline diamond (PCD). The feedthrough 209, the electrical contact 218, and the integrated contacts within the end alignment portion 208, charge segments 202-203, and detonator sleeve 210 may form a full electrical path 204 through the gun system 200. The electrical path 204 may allow electricity to be transferred through the gun system 200 without the use of wires. The electrical path 204 may be created as adjacent components within the gun system 200 are connected together. The absence of loose electrical wires in the gun system 200 may minimize or vastly reduce operational issues associated with the loss of electrical connections downhole, which may cause misruns of individual charges or, in some instances, the entire gun system 200 during perforating operations.

In some implementations, the feedthrough 209 may be partially overmolded. For example, the pin 222 and a spring 224 within the feedthrough 209 may be centered, and a plastic outer portion may be overmolded over the pin 222 and spring 224 via injection molding. In some implementations, the pin 222 and spring 224 may be comprised of brass, although other materials may be used. In some implementations, the feedthrough 209 may include a rubberized O-ring 216 to enhance the pressure seal formed by the feedthrough 209.

In some implementations, the feedthrough 209 may be configured as a coaxial feedthrough to accommodate two electrical paths through it. For example, each of the charge segments 202-203 may comprise a second electrical conductor, similar in design to the electrical conductor 104 of FIG. 1. The second electrical conductor may be configured to provide a path to ground for the electrical path 204, while a primary electrical conductor disposed on the charge segments 202-203 (such as the electrical conductor 104) allows power transfer between components of the gun system 200 along the electrical path 204. In some implementations where gun systems are prone to motion, an electrical contact may be included on the gun system 200 proximate to the detonator assembly 212. Motion may induce intermittent connections which have the ability to disturb the path to ground. Thus, the electrical contact may be configured to contact the bulkhead assembly of the connected gun system, thus grounding it. Both this electrical contact and the secondary electrical conductor may improve reliability of the gun system 200 by providing multiple dedicated ground paths for the circuit(s) within the gun system 200.

The pin 222 and the spring 224 may also be configured to account for various engineering tolerances in the construction of the feedthrough 209, the assembly of the gun system 200 itself, and tolerances when forming a threaded connection between two gun systems. In some implementations, the spring 224 may spring-load the pin 222, allowing the pin to accommodate a plurality of distances when coupling to the detonator of a secondary gun system. When two gun systems are jointed, the pin 222 may contact the electrical contact of a proximate detonator assembly. The spring 224 may account for variations when forming the threaded connection.

Example Gun System Assembly

Figure 3:
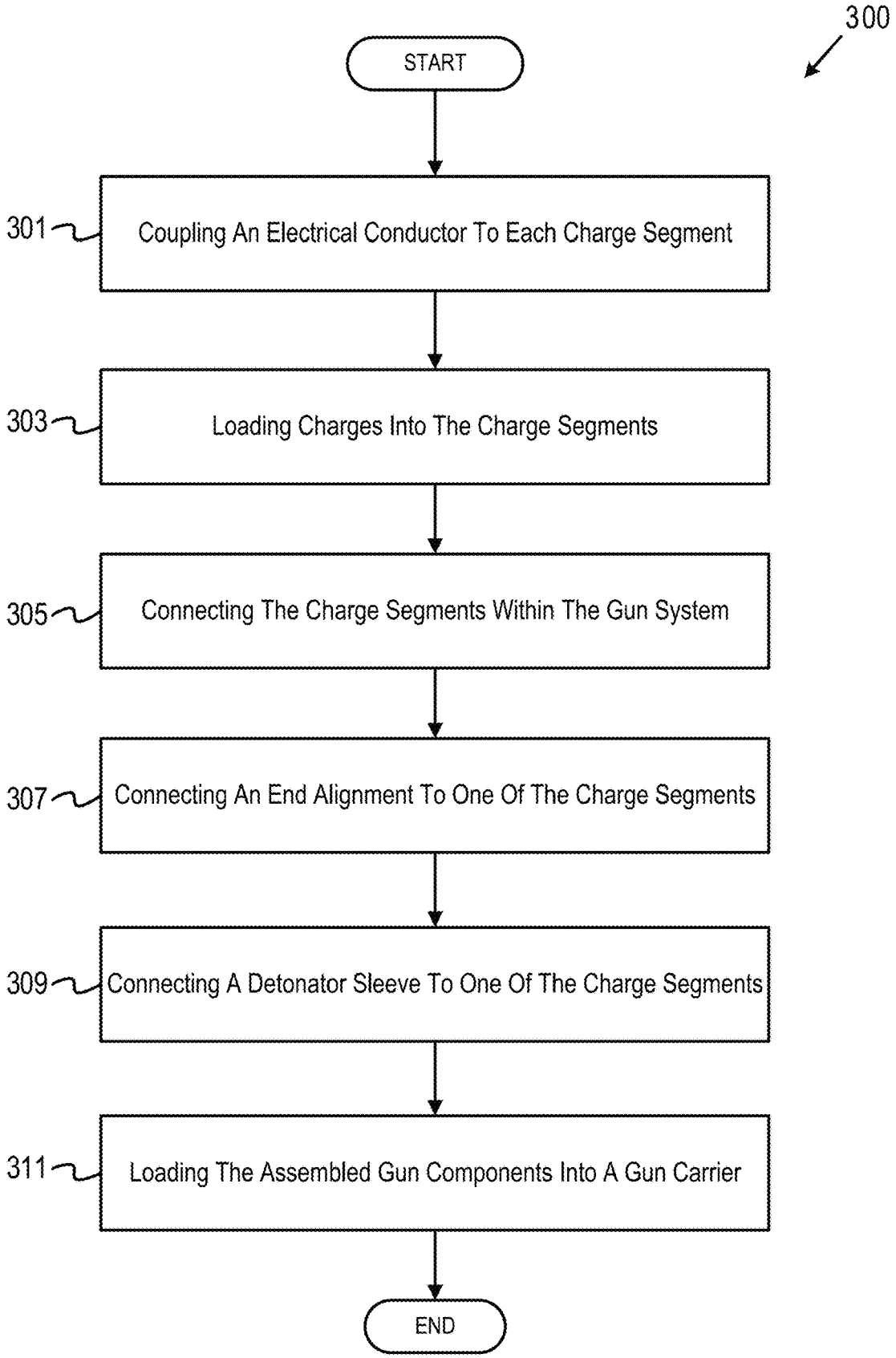
FIG. 3 is a flowchart depicting a method for assembling a segmented modular gun system without electrical wires, according to some implementations.

FIG. 3 is a flowchart depicting a method 300 for assembling a segmented modular gun system without electrical wires, according to some implementations. The method 300 may be described with reference to FIGS. 1-2. Operations of the method 300 may be completed using hardware, software, and any combination thereof. In some implementations, the assembly accomplished by the method 300 may be automated. Operations of the method 300 begin at block 301.

At block 301, the method 300 includes coupling an electrical conductor to each charge segment. For example, with reference to FIGS. 1, an electrical conductor 104 may be molded to a charge segment 100. In some implementations, the electrical conductor 104 may be directly molded onto a plastic element on the exterior of the charge segment 100. In other implementations, the electrical conductor 104 may be snapped into place. Flow progresses to block 303.

At block 303, the method 300 includes loading charges into the charge segments. For example, with reference to FIG. 2, charges may be loaded into the individual charge segments 202, 203. Each charge segment may accommodate one or more charges. Flow progresses to block 305.

At block 305, the method 300 includes connecting the charge segments 202, 203 within the gun system 200. The charge segments 202, 203 may be connected in an appropriate phasing and length for a desired operation. The charge segments 202-203 may be connected to one another by hand or by an automated apparatus. Flow progresses to block 307.

At block 307, the method 300 includes connecting the end alignment portion 208 to the charge segment 202. The end alignment portion 208 may comprise an integrated contact that is configured to connect with an integrated contact on the charge segment 202. The end alignment portion 208 may be rotated to align the charge segments 202-203 with the scallops 214-215. Flow progresses to block 309.

At block 309, the method 300 includes connecting the detonator sleeve 210 to the charge segment 203. Similar to the end alignment portion 208, the detonator sleeve 210 may also comprise an integrated contact configured to couple with an integrated contact of the charge segment 203. The integrated contacts may be configured to both mechanically and electrically couple the components within the gun system 200. The integrated contacts may form a pathway for electrical power to travel between components, similar to the electrical path 204 of FIG. 2. Flow progresses to block 311.

At block 311, the assembled gun components are loaded into a gun carrier. For example, internal components of the gun system 200 including, but not limited to the charge segments 202-203, the end alignment portion 208, and the detonator sleeve 210 may be connected and subsequently loaded into the gun body 220 for conveyance into a wellbore. The bulkhead assembly 206 and feedthrough 209 may be coupled to the end alignment portion 208 and gun body 220. The assembled gun system 200 may be coupled with one or more additional gun systems for use in perforating various subsurface formations, cement layers, tubulars, etc. Flow of the method 300 ceases.

While the aspects of the disclosure are described with reference to various implementations and exploitations, it will be understood that these aspects are illustrative and that the scope of the claims is not limited to them. In general, techniques for perforation gun assembly and deployment as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

EXAMPLE IMPLEMENTATIONS

Implementation #1: A modular gun system for use in a wellbore, the modular gun system comprising: one or more charge segments each including a first electrical conductor having a first set of integrated electrical contacts.

Implementation #2: The modular gun system of Implementation 1, further comprising: a feedthrough configured to maintain a pressure barrier of the modular gun system; an end alignment including a second set of integrated electrical contacts, wherein the end alignment electrically couples the feedthrough to the one or more charge segments; and a detonator sleeve including a third set of integrated electrical contacts, wherein the detonator sleeve is electrically coupled to the one or more charge segments, wherein the first, second, and third sets of integrated electrical contacts each include one or more conductive contacts configured to form an electrical path in the modular gun system.

Implementation #3: The modular gun system of any one or more of Implementations 1-2, further comprising: one or more sacrificial regions disposed on an exterior of a gun body of the modular gun system, wherein the end alignment is configured to align the one or more charge segments with the one or more sacrificial regions, wherein each of the one or more charge segments is configured to house one or more charges, wherein the one or more charges are used to perforate the wellbore.

Implementation #4: The modular gun system of any one or more of Implementations 1-3, wherein the end alignment comprises an outer diameter greater than an inner diameter of at least a portion of the gun body, wherein the outer diameter of the end alignment aligns the end alignment and the one or more charge segments with an axis of the gun body.

Implementation #5: The modular gun system of any one or more of Implementations 1-4, wherein the one or more charge segments are connected to one another, and wherein a desired phasing of the modular gun system is achieved by altering a radial angle of the one or more charge segments when forming the connection.

Implementation #6: The modular gun system of any one or more of Implementations 1-5, wherein the one or more charge segments each comprise a second electrical conductor, wherein the second electrical conductor is configured to provide a path to ground for electrical power.

Implementation #7: The modular gun system of any one or more of Implementations 1-6, wherein the first electrical conductor includes a male connection at a first end and a female connection at a second end.

Implementation #8: The modular gun system of any one or more of Implementations 1-7, wherein the male and female connections of the first electrical conductor are configured to form one of a pin and socket style connection, a spring and plate style connection, a locking collet and extruded tab connection, a mechanical crimp connection, a standard collet and tab cutout connection, and a movable bent tab connection.

Implementation #9: The modular gun system of any one or more of Implementations 1-8, wherein at least part of the feedthrough is overmolded over an internal pin and spring, and wherein the internal pin is configured to electrically couple to a detonator of a second gun system.

Implementation #10: An apparatus for use in a downhole tool, the apparatus comprising: a first charge segment having one or more charges; a first electrical conductor coupled to the first charge segment, wherein the first electrical conductor is configured to carry electrical power to a detonator; and one or more integrated electrical contacts disposed on the first charge segment.

Implementation #11: The apparatus of claim 10, wherein the one or more integrated electrical contacts are configured to transfer the electrical power from the first electrical conductor to a second charge segment.

Implementation #11: The apparatus of Implementation 10, wherein the one or more integrated electrical contacts are configured to transfer the electrical power from the first electrical conductor to a second charge segment.

Implementation #12: The apparatus of any one or more of Implementations 10-11, wherein the first charge segment is formed from an electrically-insulated molded plastic.

Implementation #13: The apparatus of any one or more of Implementations 10-12, wherein the first charge segment is overmolded over the first electrical conductor.

Implementation #14: The apparatus of any one or more of Implementations 10-13, further comprising: a second electrical conductor coupled to the first charge segment, wherein the second electrical conductor is configured to provide a path to ground for the electrical power.

Implementation #15: A method for assembling a wireless modular gun system for use in a wellbore, the method comprising: coupling a first electrical conductor to a first charge segment; coupling a second electrical conductor to a second charge segment; loading one or more charges into the first charge segment and the second charge segment; connecting the first charge segment and the second charge segment; connecting an end alignment to the first charge segment; connecting a detonator sleeve to the second charge segment; and loading the first and second charge segments, the end alignment, and the detonator sleeve into a gun carrier.

Implementation #16: The method of Implementation 15, wherein connecting the first charge segment to the second charge segment comprises connecting the first charge segment to the second charge segment via one of a pin and socket style connection, a spring and plate style connection, a locking collet and extruded tab connection, a mechanical crimp connection, a standard collet and tab cutout connection, and a movable bent tab connection, wherein the first and second charge segments are mechanically and electrically coupled through the connection.

Implementation #17: The method of any one or more of Implementations 15-16, further comprising: connecting an integrated electrical contact of the first charge segment to an integrated electrical contact of the second charge segment; connecting an integrated electrical contact of the end alignment to the integrated electrical contact of the first charge segment; and connecting an integrated electrical contact of the detonator sleeve with the integrated electrical contact of the second charge segment.

Implementation #18: The method of claim any one or more of Implementations 15-17, further comprising: coupling an additional electrical conductor to each of the first and second charge segments, wherein the additional electrical conductor provides a path to ground for electrical power within the wireless modular gun system.

Implementation #19: The method of any one or more of Implementations 15-18, further comprising: altering a radial angle of the second charge segment based on a desired phasing; and connecting the second charge segment at the altered radial angle to the first charge segment to achieve the desired phasing.

Implementation #20: The method of any one or more of Implementations 15-19, further comprising: aligning a datum feature disposed on the first charge segment with a datum feature disposed on the second charge segment, wherein the datum features are positioned on the first and second charge segments based, at least in part, on the desired phasing; and connecting the first charge segment and the second charge segment based on the datum features.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A modular gun system for use in a wellbore, the modular gun system comprising:

one or more charge segments each including a first electrical conductor positioned along an exterior of each charge segment and a first set of integrated electrical contacts.

2. The modular gun system of claim 1, further comprising:

a feedthrough configured to maintain a pressure barrier of the modular gun system;

an end alignment including a second set of integrated electrical contacts, wherein the end alignment electrically couples the feedthrough to the one or more charge segments; and a detonator sleeve including a third set of integrated electrical contacts, wherein the detonator sleeve is electrically coupled to the one or more charge segments, wherein the first, second, and third sets of integrated electrical contacts each include one or more conductive contacts configured to form an electrical path in the modular gun system.

3. The modular gun system of claim 2, further comprising:

one or more sacrificial regions disposed on the exterior of a gun body of the modular gun system, wherein the end alignment is configured to align the one or more charge segments with the one or more sacrificial regions, wherein each of the one or more charge segments is configured to house one or more charges, wherein the one or more charges are used to perforate the wellbore.

4. The modular gun system of claim 3, wherein the end alignment comprises an outer diameter greater than an inner diameter of at least a portion of the gun body, wherein the outer diameter of the end alignment aligns the end alignment and the one or more charge segments with an axis of the gun body.

5. The modular gun system of claim 1, wherein the one or more charge segments are connected to one another, and wherein a desired phasing of the modular gun system is achieved by altering a first radial angle of each of the one or more charge segments when forming the connection.

6. The modular gun system of claim 5, wherein the one or more charge segments each comprise a second electrical conductor, wherein the second electrical conductor is configured to provide a path to ground for electrical power.

7. The modular gun system of claim 1, wherein the first electrical conductor includes a male connection at a first end and a female connection at a second end.

8. The modular gun system of claim 7, wherein the male and female connections of the first electrical conductor are configured to form one of a pin and socket style connection, a spring and plate style connection, a locking collet and extruded tab connection, a mechanical crimp connection, a standard collet and tab cutout connection, and a movable bent tab connection.

9. The modular gun system of claim 2, wherein at least part of the feedthrough is overmolded over an internal pin and spring, and wherein the internal pin is configured to electrically couple to a detonator of a second gun system.

10. An apparatus for use in a downhole tool, the apparatus comprising:

a first charge segment having one or more charges;

a first electrical conductor positioned along an exterior of the first charge segment, wherein the first electrical conductor is configured to carry electrical power to a detonator; and one or more integrated electrical contacts disposed on the first charge segment.

11. The apparatus of claim 10, wherein the one or more integrated electrical contacts are configured to transfer the electrical power from the first electrical conductor to a second charge segment.

12. The apparatus of claim 10, wherein the first charge segment is formed from an electrically-insulated molded plastic.

13. The apparatus of claim 10, wherein the first charge segment is overmolded over the first electrical conductor.

14. The apparatus of claim 10, further comprising:

a second electrical conductor coupled to the first charge segment, wherein the second electrical conductor is configured to provide a path to ground for the electrical power.

15. A method for assembling a wireless modular gun system for use in a wellbore, the method comprising:

connecting a first charge segment having a first external electrical conductor to a second charge segment having a second external electrical conductor;

connecting an end alignment to the first charge segment;

connecting a detonator sleeve to the second charge segment; and loading the first and second charge segments, the end alignment, and the detonator sleeve into a gun carrier.

16. The method of claim 15, wherein connecting the first charge segment to the second charge segment comprises connecting the first charge segment to the second charge segment via one of a pin and socket style connection, a spring and plate style connection, a locking collet and extruded tab connection, a mechanical crimp connection, a standard collet and tab cutout connection, and a movable bent tab connection, wherein the first and second charge segments are mechanically and electrically coupled through the connection.

17. The method of claim 15, further comprising:

connecting an integrated electrical contact of the first charge segment to an integrated electrical contact of the second charge segment;

connecting an integrated electrical contact of the end alignment to the integrated electrical contact of the first charge segment; and connecting an integrated electrical contact of the detonator sleeve with the integrated electrical contact of the second charge segment.

18. The method of claim 15, further comprising:

coupling an additional electrical conductor to each of the first and second charge segments, wherein the additional electrical conductor provides a path to ground for electrical power within the wireless modular gun system.

19. The method of claim 15, further comprising:

altering a radial angle of the second charge segment based on a desired phasing; and connecting the second charge segment at the altered radial angle to the first charge segment to achieve the desired phasing.

20. The method of claim 19, further comprising:

aligning a datum feature disposed on the first charge segment with a datum feature disposed on the second charge segment, wherein the datum features are positioned on the first and second charge segments based, at least in part, on the desired phasing; and connecting the first charge segment and the second charge segment based on the datum features.

* * * * *